US005363572A

United States Patent [19]

Marega et al.

[11] Patent Number: 5,363,572

[45] Date of Patent: Nov. 15, 1994

[54] LATERAL-INCLINATION ADJUSTING DEVICE FOR SKI-BOOTS

[75] Inventors: Antonello Marega, Volpago del Montello; Goggia Giuseppe, Montebelluna; Breda Marco, Arcade, all of Italy

[73] Assignee: Calzaturificio Tecnica Spa, Treviso, Italy

[21] Appl. No.: 56,389

[22] Filed: May 4, 1993

[30] Foreign Application Priority Data

May 15, 1992 [IT] Italy ..... PD92 U 000055

[51] Int. Cl.[5] ..... A43B 5/04

[52] U.S. Cl. ..... 36/121; 36/117

[58] Field of Search ..... 36/117, 119, 120, 121

[56] References Cited

U.S. PATENT DOCUMENTS

| | | | |
|---|---|---|---|
| 2,387,724 | 10/1945 | Elman et al. | 220/345 X |
| 3,721,023 | 3/1973 | Kastinger | 36/120 |
| 3,885,329 | 5/1975 | French | 36/117 |
| 4,334,368 | 6/1982 | Chalmers, II et al. | 36/120 |
| 4,360,979 | 11/1982 | Spademan | 36/121 |
| 4,539,764 | 9/1985 | Pradier | 36/121 |
| 4,601,118 | 7/1986 | Zanatta | 36/121 |
| 4,615,128 | 10/1986 | Borsoi | 36/120 |
| 5,033,210 | 7/1991 | Dodge et al. | 36/121 |

FOREIGN PATENT DOCUMENTS

| | | | |
|---|---|---|---|
| 0111472 | 6/1984 | European Pat. Off. . | |
| 0356400 | 2/1990 | European Pat. Off. . | |
| 3427644 | 1/1986 | Germany | 36/119 |

*Primary Examiner*—Paul T. Sewell
*Assistant Examiner*—Ted Kavanaugh
*Attorney, Agent, or Firm*—Griffin, Butler, Whisenhunt & Kurtossy

[57] ABSTRACT

Improved lateral-inclination adjusting device applied to a leg-piece (14) mounted on a shell (12) of a ski-boot comprising on top of a seating (64), containing a screw (60) screwed into a ring-nut (22) extended by an internally threaded hollow shank (28), a protection cover (80) which is suitably inserted and which conceals and protects the head (62) of the screw (60), preventing exposure to external agents and the risk of losing said screw (60).

6 Claims, 3 Drawing Sheets

IV-IV

III-III

LATERAL-INCLINATION ADJUSTING DEVICE FOR SKI-BOOTS

The present invention relates to a lateral-inclination adjusting device for the leg-piece of a ski-boot, in which use is made of a protective means for covering, concealing and protecting fixing members which can be loosened as required, with the aim of safeguarding them from a hostile environment and preventing accidental loss of their parts.

BACKGROUND OF THE INVENTION

Means for adjusting the lateral inclination of ski-boot leg-pieces, with respect to the shells of said boots, have been known for some time, such as those described and claimed in the U.S. Pat. No. 4,601,118.

Said means consist essentially of a first toothed block connected to the leg-piece and a second toothed block connected to the shell, with the teeth being kept mutually engaged by means of a pin or screw passing through appropriate openings formed in said blocks and engaging in a threaded hole present in a ring-nut positioned inside the shell.

These means function reasonably well and have been well-received by the athletes who use the types of boots on which they are fitted.

However, they still have a few drawbacks connected with the exposure of the pin, or screw, to the external environment which, in the case of ski-boots, may give rise to a series of problems associated with possible seizing of threaded or unthreaded parts of said pin or screw owing to the formation of oxide layers, or the introduction and trapping of foreign substances between said pin and the openings in the blocks, or the accidental loss of the threaded pin, or screw, which would make the ski-boot difficult if not impossible to use.

SUMMARY OF THE INVENTION

This drawback is overcome by the present invention which envisages protection of the exposed zone, or head, of the threaded pin, or screw, by accommodating the said head in a seating formed on an external surface of a base element integral with the leg-piece and then closing off the said seating with a cover which can applied and/or removed to or from the said seating as required.

In particular, said cover is an insert in the form of a plate which can be slidably introduced into guides arranged along opposite, substantially parallel sides of said seating.

More particularly, said cover is provided with two, vertically oriented, projecting, parallel guides which can be inserted into recessed parallel guides formed along vertical edges of said seating.

The cover may obviously be of a different type: for example, hinged on one side and mounted on the other side or mounted on two or more snap-engaging teeth and hence removable in the event of adjustment.

In particular, the threaded pin, or screw, is associated with a flag or position indicator which makes it possible to see the position of the said pin or screw even when the cover closes off the seating.

Overall, the adjusting device according to the present invention comprises, from the inside:

a flat ring-nut provided with a cylindrical shank having a threaded through-cavity, ending in a remote zone which is flattened, at least on one side, and inserted into a hole in the ski-boot shell, said flattened zone being inserted in a substantially precise manner into a similarly shaped window of a toothed plate resting on the outside of the boot shell, the toothing of which is directed outwards and engages in a corresponding toothing formed on an internal surface of a base element which can in any case be fixed to a boot leg-piece and is provided with an elongated window which can be positioned over the window of the toothed plate, so as to allow the passage of a screw which is to be screwed into the threaded through-cavity of the abovementioned ring-nut, said elongated window emerging inside a seating present in said base and facing outwards, which can be closed off by means of a cover which can be inserted into lateral guides of the seating of said base, and the said screw supports, underneath its head, a position indicator consisting of a perforated plate provided with a folded-back lug which passes out through a slot parallel to one side of the said seating so as to indicate externally the position of the screw and hence of the internal toothed plate with respect to the external cover and, consequently, the relate position of the shell with respect to the leg-piece.

BRIEF DESCRIPTION OF THE DRAWINGS

The characteristic features of the present invention are specified in detail in the concluding part of the present description. However, these characteristic features, together with other features and advantages, will emerge more clearly from the following detailed description of a non-limiting example of embodiment of the invention, accompanied by the attached drawings, in which.

DESCRIPTION OF PREFERRED EMBODIMENTS

Figure 1:
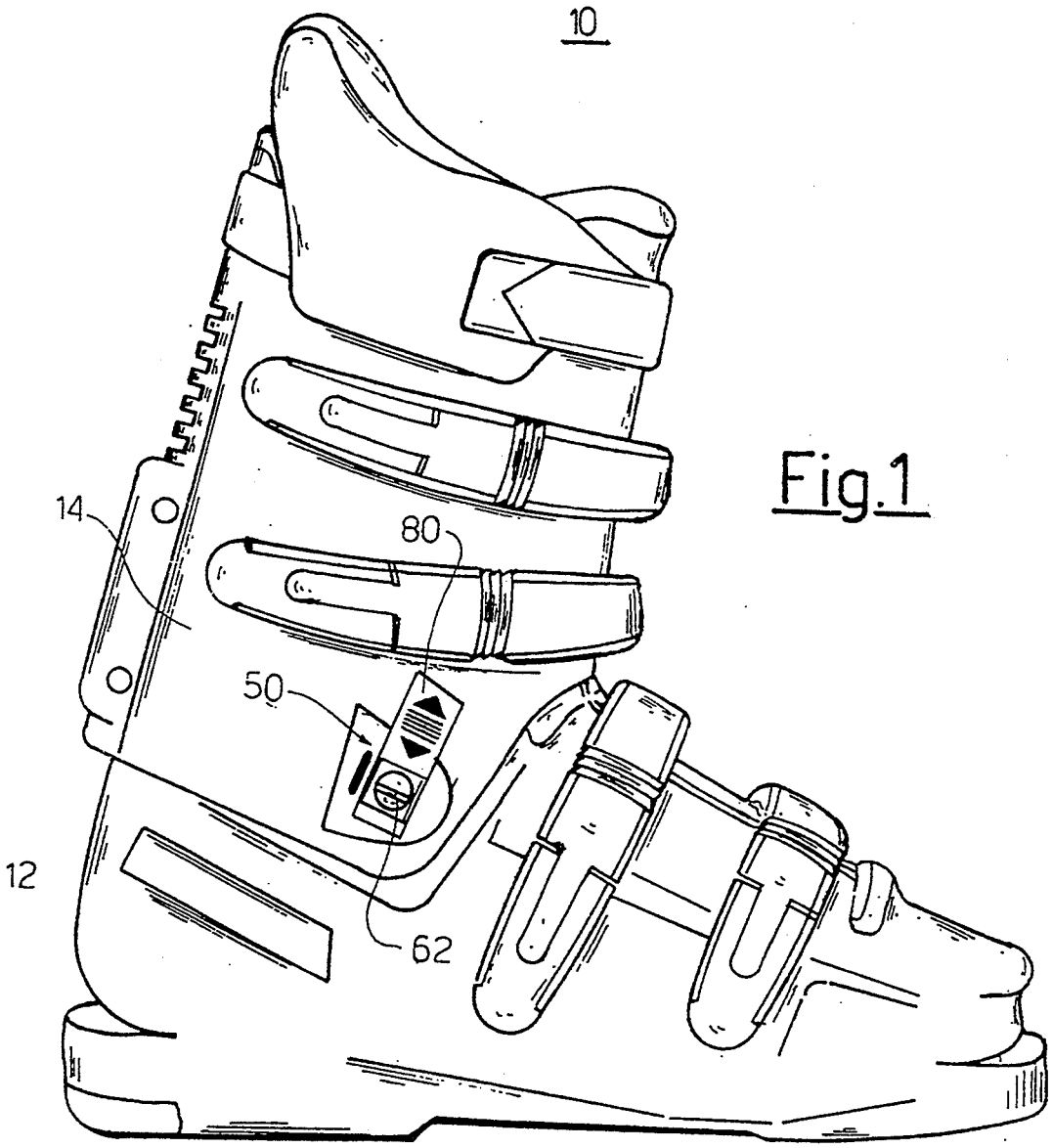
FIG. 1 is a side view of a ski-boot provided with the improved adjusting device according to the present invention.
Figure 2:
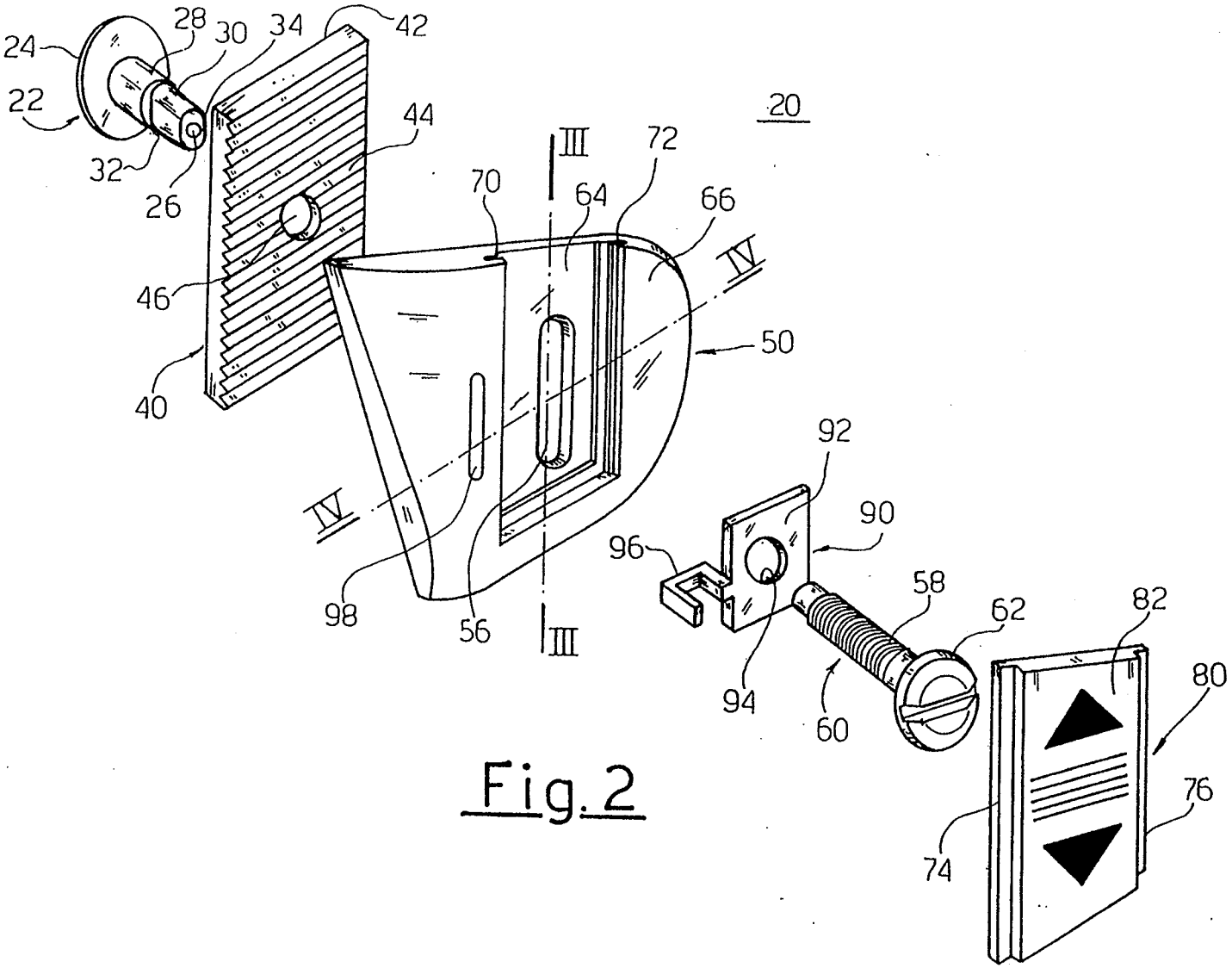
FIG. 2 is an exploded perspective view showing the main elements which form the adjusting device according to the present invention.
Figure 4:
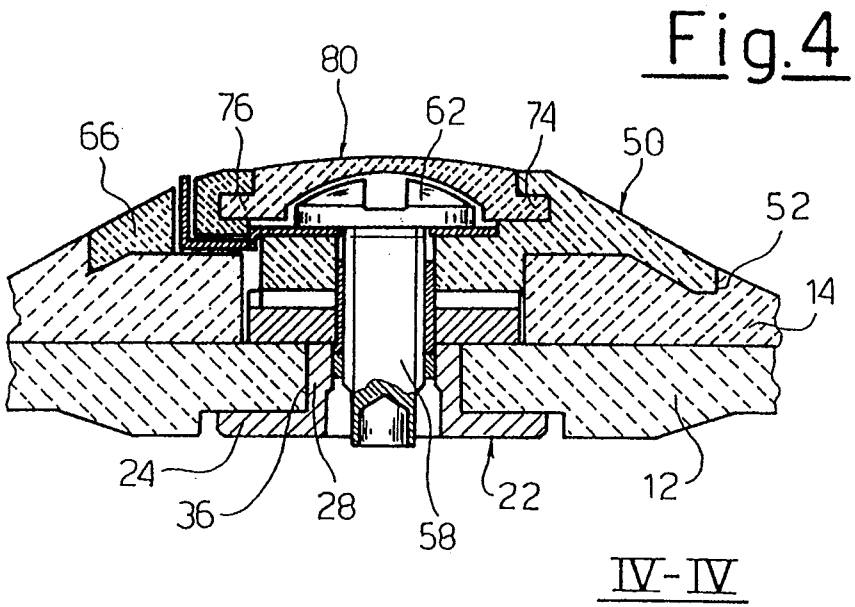
FIG. 4 is a horizontal section, along the line IV—IV, of the said adjusting device.
Figure 3:
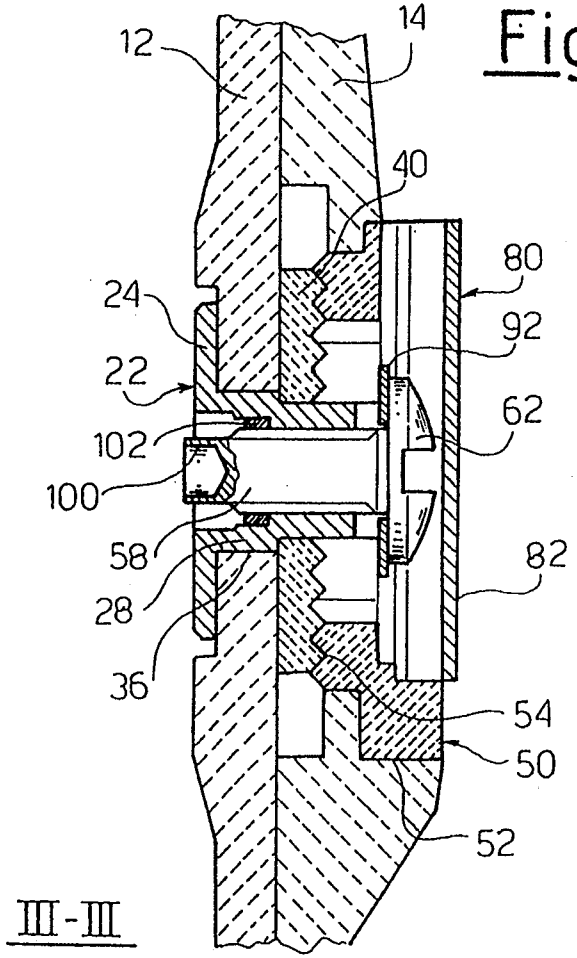
FIG. 3 is a vertical section, along the line III—III, of the said adjusting device according to the present invention.

If we consider the figures, it can be seen that a ski-boot 10 comprising rigid shell 12 and a leg-piece 14, which is also rigid, is provided with at least one device for adjusting the lateral inclination of the leg-piece denoted by 20 in FIG. 2. Said adjusting device 20 comprises essentially, from the inside to the outside of the boot, a ring-nut 22 provided with a flat head 24, an internally threaded through-hole 26 and a cylindrical shank 28 terminating in a portion 30 with a narrow diameter and provided with two flat surfaces 32 and 34, where most of the shank 28 engages in a corresponding hole 36 present in the shell 12 of the boot (see in particular FIGS. 3 and 4).

The tapered portion 30 of the shank of the ring-nut 22 receives a plate 40 provided with a smooth surface 42 facing the shell 12, with a toothed surface 44 opposite the smooth surface 42 and with a through-window 46 which can be inserted with precision onto the tapered portion 30 of the shank 28 and shaped like the said portion, so as not to rotate with respect to the ring-nut 22. It will be noted, however, that the ring-nut 22 must be free to rotate about its axis with respect to the shell 12 so as to allow any adjustment in the inclination of the leg-piece forwards or backwards with respect to the shell 12 since, owing to the fact that the plate 40 follows the leg-piece 14, it is inclined forwards and backwards in the sam manner as the said leg-piece and the ring-nut 22 remains integral with the said plate 40. For this reason the shank 28 is perfectly circular in the region of the portion passing through the hole 36 of the shell and is provided with flat surfaces 32 and 34 in the region of the portion 30 passing through the window 44 of the plate 40.

On top of the plate 40 there rests a base 50 which is mounted in a corresponding recess 52 in the leg-piece 14 and is provided at the rear with a toothed surface 54 fitting together perfectly with the toothed surface 44 of the plate 40 and provided with an elongated through-window 56 designed to receive a threaded shank 58 of a screw 60 which terminates in a head 62 resting on the bottom of a substantially rectangular seating 64, in the said base 50, which is open on the side of its external surface 66. The seating 64 is provided along two of its substantially vertical parallel edges with two recessed guides 70 and 72 which serve to receive two projecting edges 74 and 76 of a substantially rectangular cover which can be slidably inserted so as to close off the seating 64.

Between the head 62 of the screw 60 and the bottom of the seating 64 there is located a signalling flag 90 formed by a substantially square plate 92 provided with a hole 94 and a folded-back lug 96 which projects out from an elongated slot 98 formed in the said external surface 66 of the base 50, thus providing an indication of the position of the screw 60, and hence of the plate 40, with respect to the base 50, and, finally, of the relative position of the leg-piece 14 with respect to the shell 12, thus providing for the required adjustment of the lateral inclination of the boot 10.

So as to prevent accidental loss of the screw 60, its threaded shank 58 terminates internally with a substantially conical cavity 100 which can be suitably widened by means of punching so as to expand the internal end of the shank 58 with the aim of preventing it from passing through the threaded hole 26 of the ring-nut 22, this also being achieved with the aid of a small rubber ring 102. The cover 80 prevents in any case the screw 60 from coming out, increasing the safety of the adjusting device and overcoming the following usual drawbacks:

a) partial unscrewing of the screw, following inadequate tightening and as a result of the vibrations generated during use of the boot, which causes mutual disengagement of the teeth of the two blocks and loss of the relative position between shell and leg-piece, with the consequent need for readjustment of the inclination;

b) when, owing to incorrect use of the screw, the enlarged end part 100 of the screw 60 is damaged to the point that the screw itself is able to come free completely as a result of inadequate tightening and vibrations during use, the screw may become totally unscrewed and be lost, making the boot impossible to use.

Furthermore it is obvious that the cover 80, by closing off the entrance to the seating 64, prevents water, snow, dirt and any foreign bodies which may damage operation of the screw 60 from entering the said seating and coming into contact with the said screw 60.

The mode of operation of the system described above is as follows: when the skier intends modifying the inclination of the leg-piece 14 with respect to the shell 12, he/she removes the cover 80 from the seating 64, slackens the screw 60 by the amount required to free the toothed surface 54 of the base 50 from the toothed surface 44 of the plate, positions the leg-piece 14 in the desired manner with respect to the shell 12, tightens agains the screw 60 and reinserts the cover 80 into the seating 64. The operation is substantially identical to that which was performed with the invention of the abovementioned U.S. Pat. No. 4,601,118 with the addition of removal and reinsertion of the cover 80 from-/into the seating 64.

The above explanation represents the description of a non-limiting example of embodiment of the invention and it is obvious that any equivalent measure or solution which may occur to a person skilled in the art after reading the abovementioned description must be regarded as protected herein.

We claim:

1. In a lateral inclination adjusting device for a leg piece of a ski-boot comprising an elongated threaded member, which passes through an elongated window formed in a base integral with the leg-piece and which threaded member is engageable at a distal end with a thread nut disposed at an inside surface of a shell of the ski-boot, a toothed plate having outwardly directed teeth, said toothed plate being disposed between the nut and the base and the teeth of which are engageable with inwardly directed teeth on an inward surface of base, such that the outwardly directed teeth and the inwardly directed teeth are disengageable by loosening the threaded member for adjusting the lateral inclination of the leg piece and said teeth are engageable to maintain an adjusted lateral inclination of the leg piece by tightening the threaded member, the improvement comprising a seating formed in an external surface of the base for receiving a head of the threaded member, a removable and replaceable cover over said seating for protecting the head and seating, and a positioning indicator having a plate with a hole for passing therethrough the threaded member and a folded-back lug configured to pass through an elongated slot disposed on the base, said slot being disposed parallel to a side of the seating so as to externally indicate the lateral inclination position of the leg piece with respect to the shell.

2. Adjusting device according to claim 1, wherein said cover is an insert in the form of a plate which can be slidably introduced into guides (70, 72) arranged along opposite substantially parallel sides of said seating.

3. Adjusting device according to claim 2, wherein said seating has recessed parallel guides formed along vertical edges of the seating and the cover is provided with two projecting parallel guides which are oriented vertically and can be inserted into said recessed parallel guides.

4. Adjusting device according to claim 1, wherein said cover is an insert which is mountable and removable.

5. Adjusting device according to claim 1, wherein the position indicator indicates a position of the leg piece when the cover is over the seating.

6. Adjusting device according to claim 1, wherein the threaded nut is a flat ring-nut provided with a cylindrical shank having a threaded through-cavity ending in a remote tapered zone which is flattened, at least on one side, and inserted into a hole in the shell, said tapered and flattened zone being also inserted in a window (46) of the toothed plate (40) and an elongated window can be positioned over the window of the toothed plate, so as to allow the passage of the threaded member which is threaded into the threaded through-cavity of the ring-nut, said elongated window emerging inside the seating.

* * * * *